US005833115A

United States Patent [19]

Eiten

[11] Patent Number: 5,833,115

[45] Date of Patent: Nov. 10, 1998

[54] CONTAINER

[75] Inventor: Carl Thomas Eiten, Byron, Ill.

[73] Assignee: Dean Foods Company, Franklin Park, Ill.

[21] Appl. No.: 794,841

[22] Filed: Feb. 4, 1997

[51] Int. Cl.[6] ..... B65D 1/02

[52] U.S. Cl. ..... 220/669; 215/382; 215/398; 206/509

[58] Field of Search ..... 220/669, 672; 206/509; 215/382, 398

[56] References Cited

U.S. PATENT DOCUMENTS

| | | | |
|---|---|---|---|
| D. 203,226 | 12/1965 | Schnur et al. . | |
| D. 247,280 | 2/1978 | Grodin . | |
| D. 307,389 | 4/1990 | Larson . | |
| D. 332,747 | 1/1993 | Darr et al. . | |
| 3,397,724 | 8/1968 | Bolen et al. | 215/382 X |
| 3,616,943 | 11/1971 | Brink | 206/509 X |
| 3,708,082 | 1/1973 | Platte . | |
| 4,016,995 | 4/1977 | Frazer | 215/382 X |
| 4,372,455 | 2/1983 | Cochran | 215/398 X |
| 4,846,359 | 7/1989 | Baird et al. . | |
| 5,002,199 | 3/1991 | Frahm | 206/509 X |
| 5,318,787 | 6/1994 | Brauner et al. . | |

*Primary Examiner*—Steven M. Pollard
*Attorney, Agent, or Firm*—Bell Seltzer Intellectual Property Group of Alston & Bird, LLP

[57] ABSTRACT

There is provided a plastic container having a bottom portion, side wall portions, and a top wall portion. The side wall portions include four face panels, and four somewhat narrower in width connector panels connected at their vertical sides to one side of each one of the face panels, respectively. The connection of the four face panels and the four connector panels forms an octagon. There is an area in each side wall portion between the bottom portion and the top wall portion which is indented inwardly a slight amount. Within the area of the indented portion there is a plurality of concave horizontal ribs circumscribing at least part way around the side wall portion. The top wall portion extends from the side wall portions and merges to a neck which defines an outlet for the container. The container includes a round handle which combats weakness during light weighting. On the shoulder of the top wall portion approaching the neck there are raised supports which improve top loading. In another feature of the present invention, the bottom portion has a concave groove extending across its bottom. The cross-bottom groove may incorporate a lightweight rib perpendicular to the parting line and a modified parting line correction profile that runs all the way through the bottom portion.

11 Claims, 5 Drawing Sheets

CONTAINER

BACKGROUND OF THE INVENTION

The present invention relates to improvements in plastic containers. More particularly, the present invention relates to a stable plastic container particularly for use in the juice and related industries.

Every day many thousands of one gallon and other size plastic containers are used for milk and other liquids. One of the significant costs in the production of such containers is the amount of resin required to produce the bottle or jug. Manufacturers attempt to reduce the cost of containers by reducing the amount of resin used to make each one. Even a small reduction in resin content results in significant savings when many thousands of containers are produced. However, when the resin content is reduced past a certain point, it is difficult to provide the strength in the corners and walls of the containers that is necessary to result in a stable container and which will retain an attractive appearance.

When containers become unstable, the result is bulging or sagging of the container walls. Also, unstable containers often have characteristics that cause dimpling at the corners of the containers during filling or pouring. To overcome these problems, various design modifications have been proposed to stabilize plastic containers. One such example is shown in U.S. Pat. No. 3,708,082 to Platte which discloses a plastic container having walls designed to minimize deformation during filling and storage. The main walls are tapered outwardly at their top ends and the corner walls are tapered outwardly at their bottom ends so that when they are joined together the container will appear to have vertical edges when the container is filled. Platte also recognizes the value of concave ribs circumscribing the container.

In proposing modifications to plastic containers to provide stable designs, it is also necessary to provide sufficient space on the outer surface of the container walls to carry the labeling necessary to comply with the National Label Act.

Despite efforts to provide stable plastic containers using less resin, there continues to be a need for improvements in plastic containers so that low cost stable containers can be produced.

SUMMARY OF THE INVENTION

It is therefore a general object of the present invention to provide an improved plastic container.

Another object of the present invention is to provide a plastic container which is constructed so as to be stable, permitting relatively lesser amounts of resin to be used in forming the container.

According to the present invention there is provided a plastic container having a bottom portion, side wall portions, and a top wall portion. The side wall portions include four face panels, and four somewhat narrower in width connector panels connected at their vertical sides to one side of each one of the face panels, respectively. The connection of the four face panels and the four connector panels forms an octagon.

There is also provided an area in each side wall portion between the bottom portion and the top wall portion which is indented inwardly a slight amount. The octagon body shape and the indention in the side wall portions disperses internal pressure to reduce panel budge and provides a protected area for a container label. Additional support is provided by having a plurality of concave horizontal ribs circumscribing at least part way around the side wall portion. The horizontal ribs may extend in a continuous manner from one face panel through a connector panel and through the adjacent face panel. Alternatively, the horizontal ribs may form discrete indentions in each panel.

In another embodiment, the horizontal ribs do not extend completely around the container. In this embodiment, two of the face panels include indentions, which are preferably circular in configuration and which may be varied in size and depth to control the amount of the contents of the container.

The top wall portion extends from the side wall portions and merges to a neck which defines an outlet for the container. The container includes a round handle which combats weakness during light weighting. On the shoulder of the top wall portion approaching the neck there are raised supports which improve top loading.

In another feature of the present invention, the bottom portion has a concave groove extending across its bottom. The cross-bottom groove may incorporate a lightweight rib perpendicular to the parting line and a modified parting line correction profile that runs all the way through the bottom portion.

As is readily apparent, there is provided a stable container designed to use less resin than conventional containers and providing a portion of the wall panels for a label.

BRIEF DESCRIPTION OF THE DRAWINGS

Other objects, features and advantages of this invention will be apparent from the following detailed description taken in conjunction with the drawings in which.

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like elements throughout.

Figure 1:
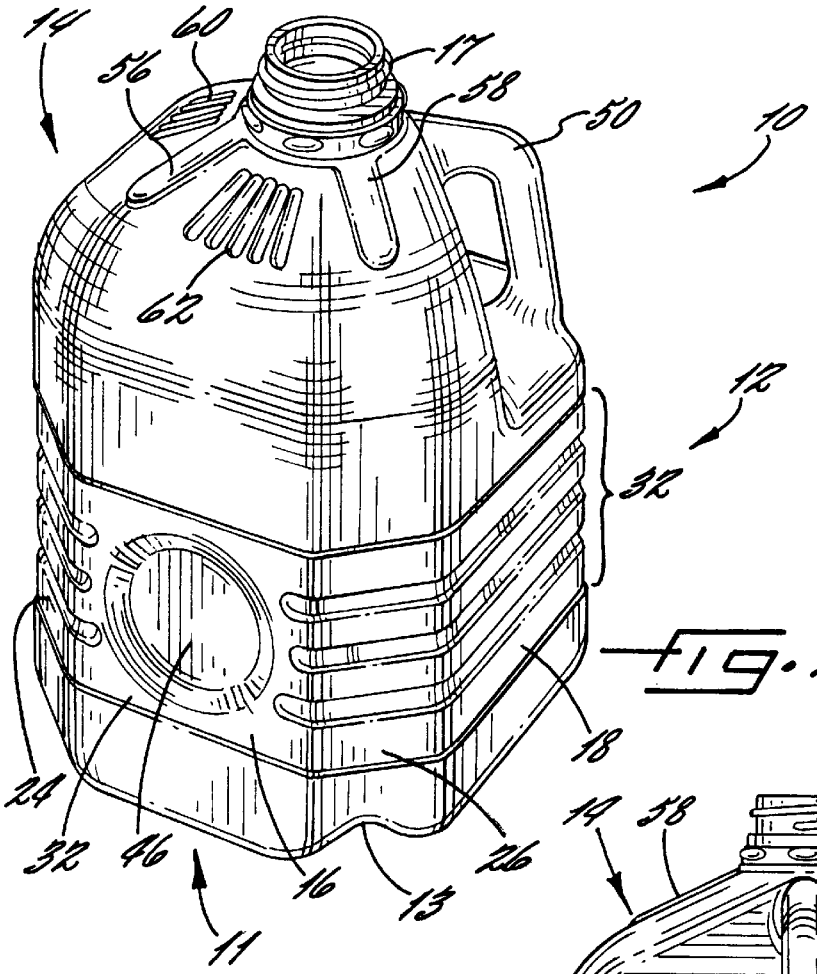
FIG. 1 is a perspective view of the plastic container of the present invention.
Figure 4:
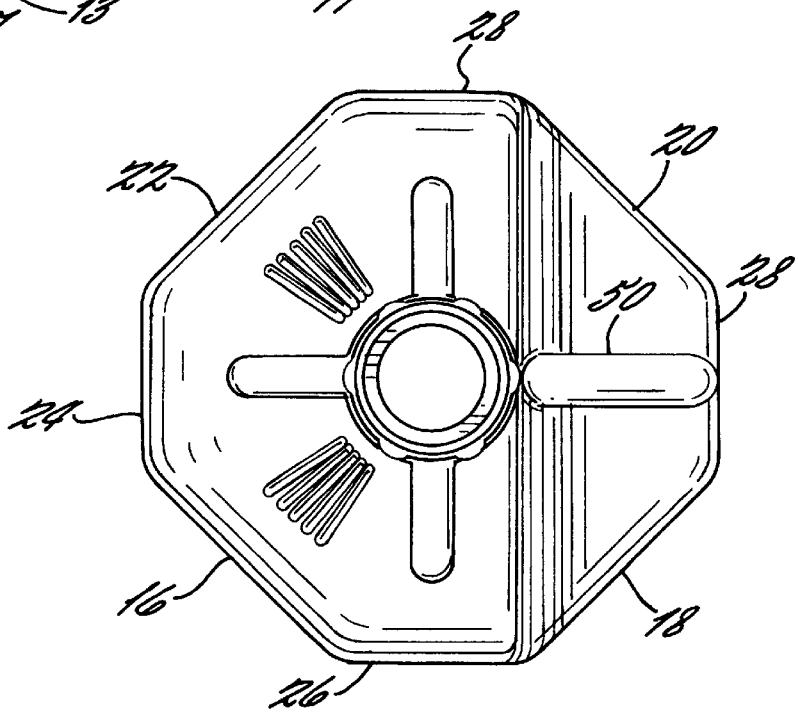
FIG. 4 is a top view of the plastic container of the present invention shown in FIG. 1.
Figure 5:
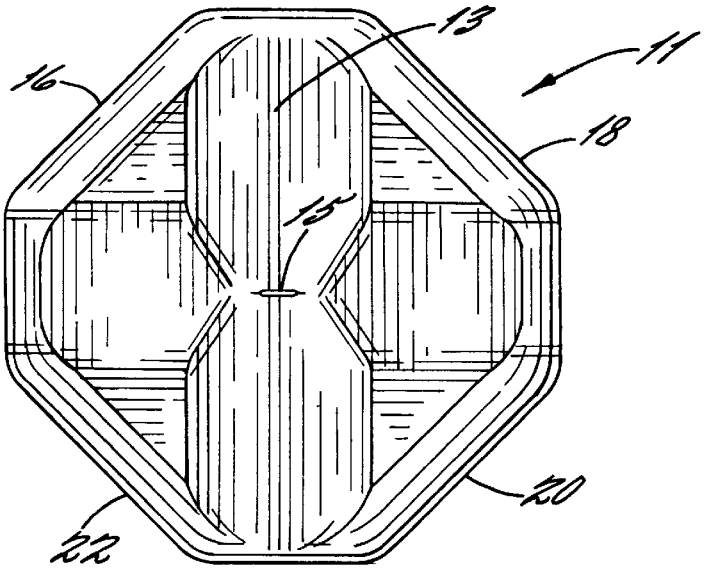
FIG. 5 is a bottom view of the plastic container of the present invention.

Referring now to the drawings, there is shown in FIG. 1 the plastic container 10 of the present invention. The container has a bottom portion 11, side wall portions designated collectively as 12, and a top wall portion 14. The side wall portions 12 include four face panels 16, 18, 20, 22, and four somewhat narrower in width connector panels 24, 26, 28, 30. The container may be made using conventional blow molding techniques; thus, each face panel is formed (or connected) at their vertical sides to one side of each adjacent panel. As shown in FIGS. 4 and 5, the connection of the four face panels and the four connector panels forms an octagon. The octagonal body shape allows for more even resin distribution during the blow molding process; thus, aiding in light weighting.

Figure 2:
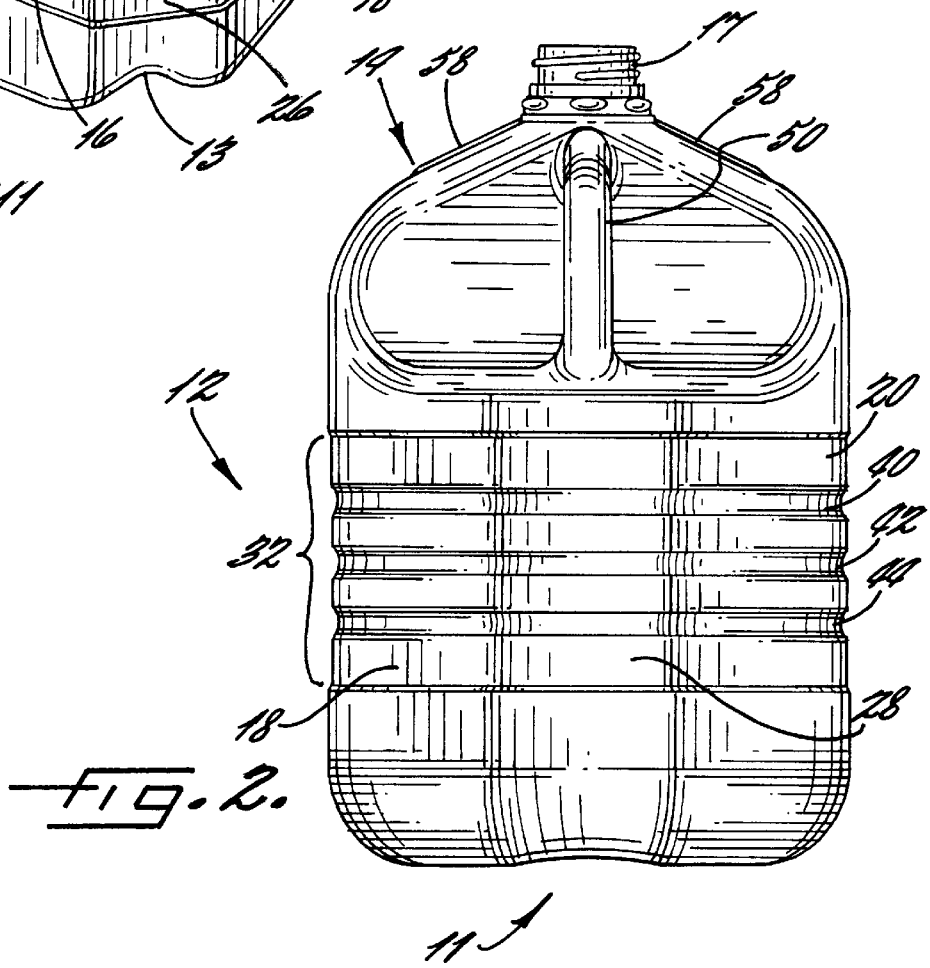
FIG. 2 is a rear elevation view of the container illustrated in FIG. 1.

As shown in FIG. 2, there is provided an area 32 in each side wall portion 12 between the bottom portion 11 and the top wall portion 14 which is recessed inwardly a slight amount. The recessed area from top to bottom should be sufficiently wide to accommodate a label surrounding the container. The recessed area is indented a sufficient amount to provide increased stability. The octagon body shape and the recessed side wall portions 12 disperse internal pressure to reduce panel budge.

In a preferred embodiment, three concave ribs 40, 42, 44, each of equal depth, circumscribe at least a portion of the container 10, namely face panels 18, 20 and connector panels 24, 26, 28, 30. It should be understood that while three ribs are preferred, the invention contemplates the use of two ribs or more. Further, the ribs may completely circumscribe the container. The ribs serve to provide strength to the container structure.

Figure 6:
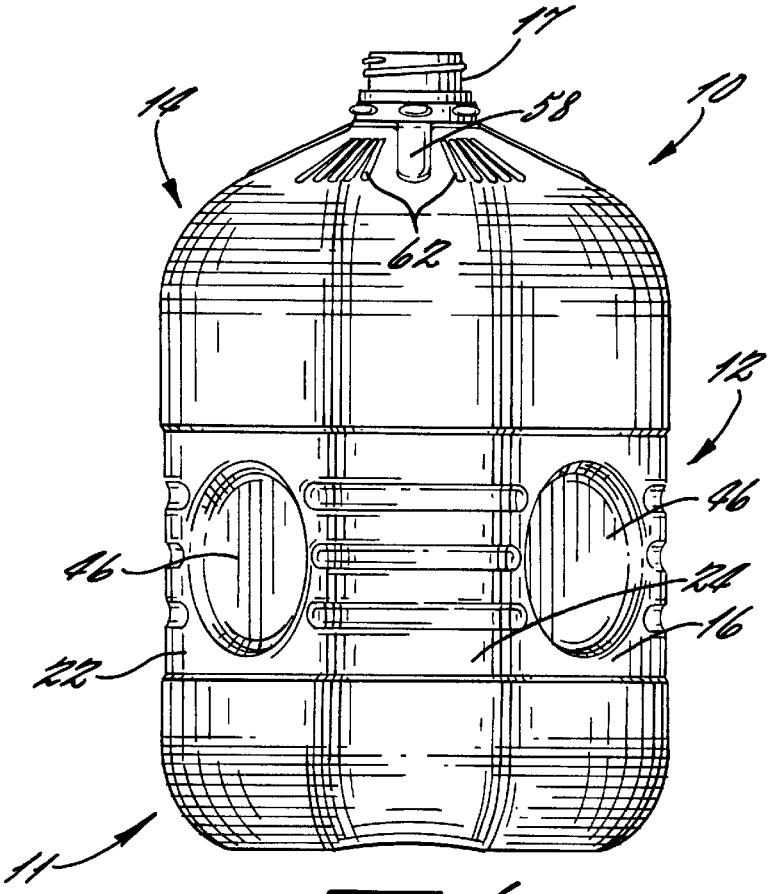
FIG. 6 is a front view of the plastic container of the present invention.
Figure 7:
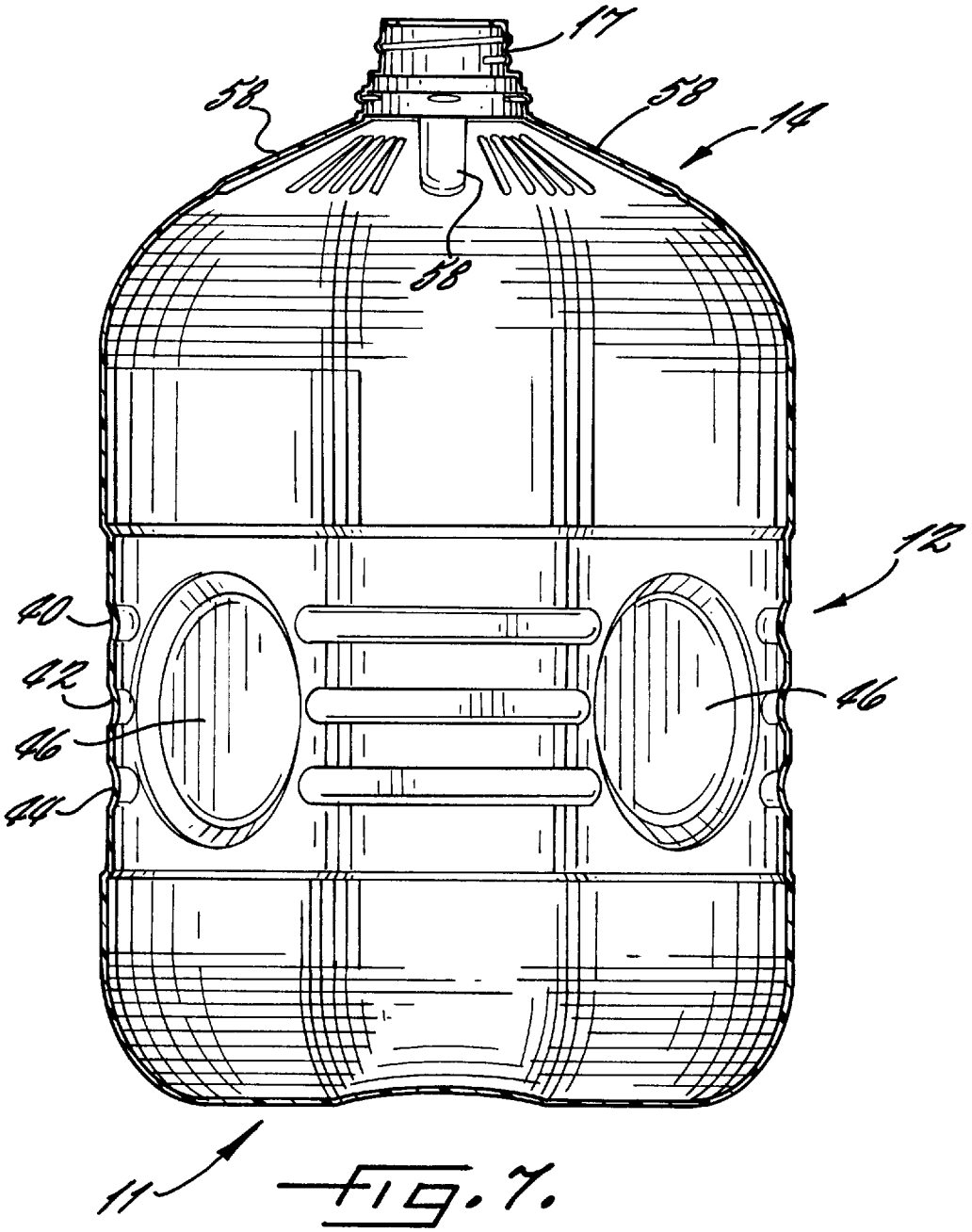
FIG. 7 is cross-sectional view taken along line 7—7 of FIG. 3.

In another embodiment, as shown in FIG. 6, face panels 16, 22 include circular indentations 46. These optional indentations 46 may be varied in size and depth and are used to control the volume of the container. The container 10 may be made using conventional blow molding techniques. In forming the containers of the present invention, it is preferable that the wall thickness be maintained the same throughout the container, as shown in FIG. 7. It should be understood, however, that there will be small variations in wall thickness, for example, ± 0.008 inch.

The top wall portion 14 extends from the side wall portions 12 and merges to a neck 17 which defines an outlet for the container. As can best be seen in FIGS. 2–4, the container has a round handle 50 which combats weakness during light weighting. The top portion 14 may include a compression rib 52, shown in FIG. 3, extending in the top portion from the upper end of the handle to the lower end of the handle to provide firmness during lifting and reduce the chance of splitting. On the shoulder of the top portion 14 approaching the neck 17 there are raised neck supports 54, 56, 58 which improve top loading. The raised neck supports 54, 56, 58 are formed by modifying the mold in the area of the neck to provide a slightly raised area. The size of each neck support may vary but is preferably an elongated ridge extending from the base of neck 17 to the shoulder of top portion 14. A series of recessed ribs 60, 62 may also be included. These recessed ribs provide additional strength in the neck area.

Figure 3:
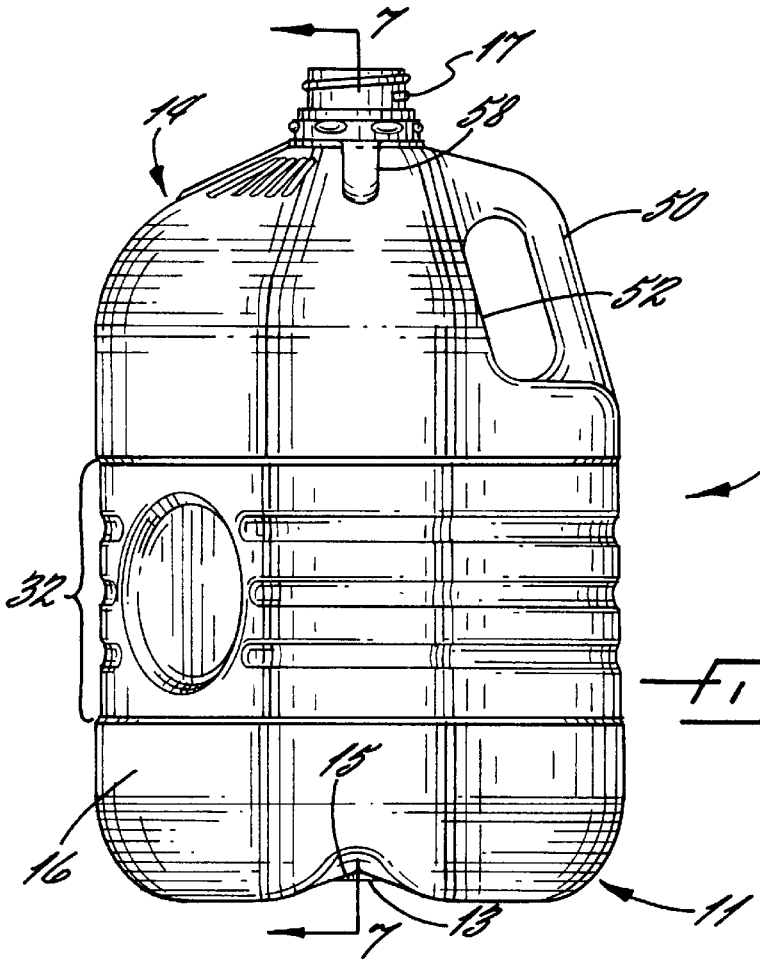
FIG. 3 is a side elevation view of the container illustrated in FIG. 1.

As shown in FIGS. 3 and 5, the bottom portion 11 has a concave groove 13 extending across its bottom. The cross-bottom concave groove 13 may incorporate a lightweight rib 15 perpendicular the parting line and a modified parting line correction profile that runs all the way through the bottom portion 11. The rib 15 serves to eliminate the traditional push-up style failure during light weighting and to provide increased stability to the bottom and prevent bulging.

Figure 8:
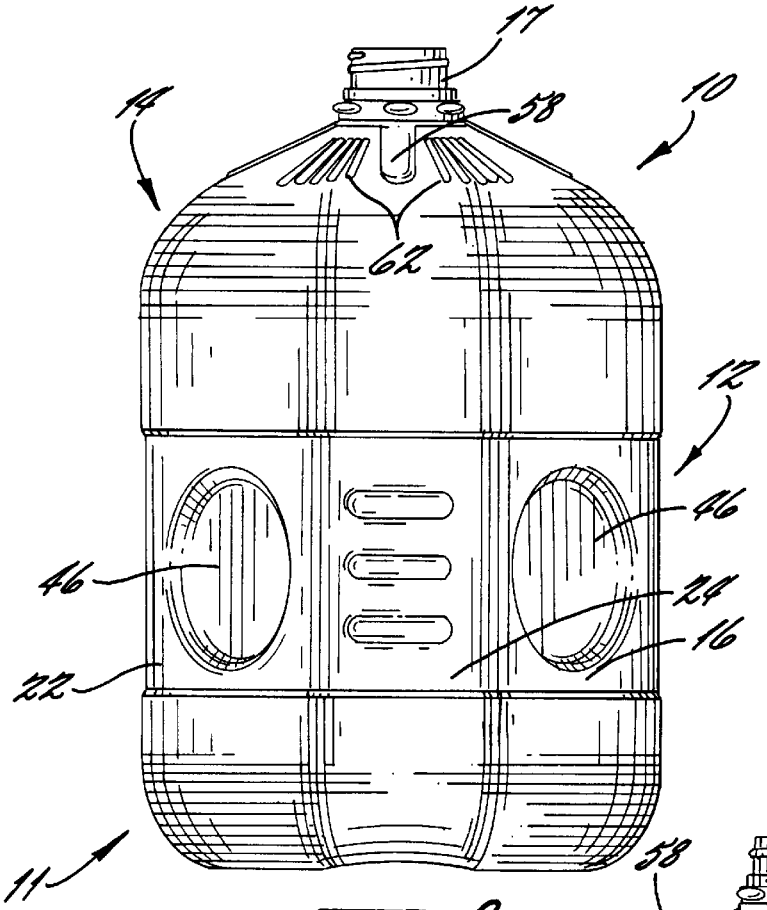
FIG. 8 is a front view of another embodiment of the container of the present invention.
Figure 9:
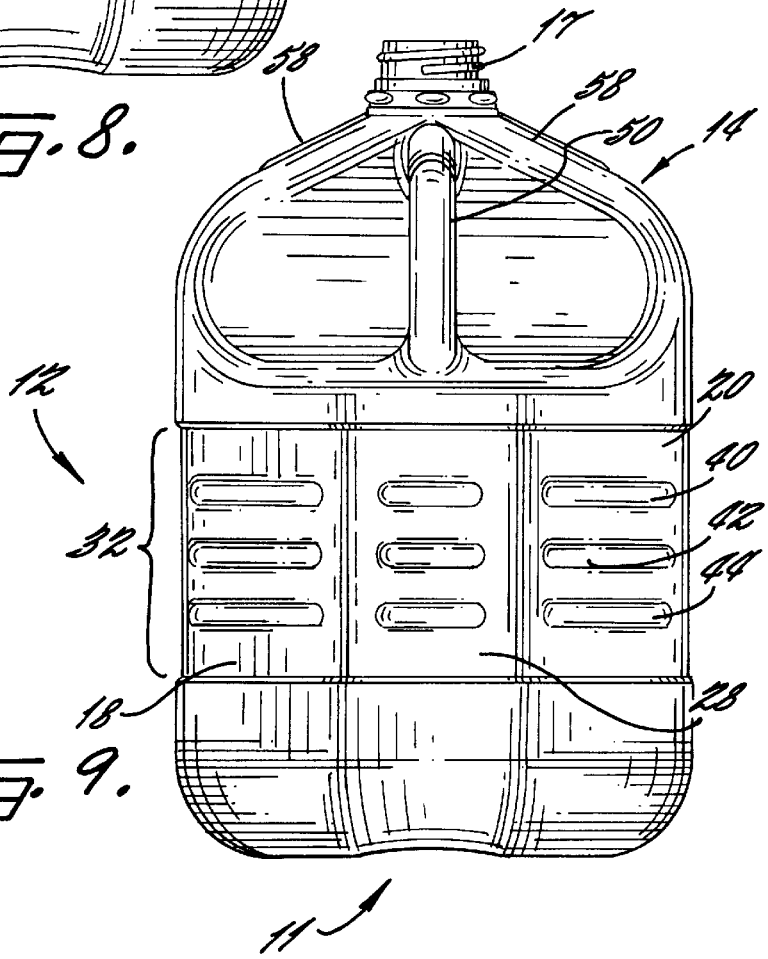
FIG. 9 is a back view of the embodiment of the container of the present invention illustrated in FIG. 8.

In FIGS. 8 and 9, there is shown another embodiment of the plastic container 10 of the present invention. In this embodiment, the bottom portion 11, the side wall portions 12 and the top wall portion 14 are similar to the embodiment of FIG. 1 except the horizontal ribs 40, 42, 44 form discrete concave indentions in the face panels 18, 20 and the connector panels 24, 26, 28, 30. In other words, the horizontal ribs do not extend around the corners in this embodiment. As shown in FIG. 8, the front panels 16, 22 may include optional indentions 46.

The containers may be made from any suitable organic plastic material such as polyethylene resin. Conventional milk containers normally use 58–65 grams of blow molding grade, high density polyethylene resin to make a one gallon container. Using the design of the present invention, a stable one gallon container may be made using only 52 grams of resin, preferably only 50 grams of resin. Among the benefits of the container design of the present invention are the ability to use a sleeve label which encircles the entire container and is placed in a protected area. Also, the eight-sided structure provides increased stability. Further, the use of less high density polyethylene resin provides cost savings.

While the present invention is particularly directed to blow molded plastic containers for milk, it should be understood that such containers can be used for other liquid food products, e.g., fruit juices and water, and even non-food items like bleach.

In the drawings and the specification, there has been set forth a preferred embodiment of the invention and, although specific terms are employed, the terms are used in a generic and descriptive sense only and not for purpose of limitation, the scope of the invention being set forth in the following claims.

That which is claimed is:

1. A plastic container comprising:

a bottom portion;

a side wall portion joined to said bottom portion comprising four face panels and four somewhat narrower in width connector panels connected at their vertical sides to one side of one of each face panel, the connection of said four face panels and said four connector panels forming an octagon, said side wall portion having a recessed area which from the top of said recess to the bottom of said recess is sufficiently wide to accommodate a label surrounding said container circumscribing at least a portion of said container; wherein at least two of said sidewall portions includes a plurality of horizontal ribs within said recessed area that circumscribe at least a portion of said container, and a top wall portion, said top wall portion extending from said side wall portions and merging to a neck which defines an outlet for the container.

2. The plastic container according to claim 1 wherein said plurality of ribs comprises three concave ribs which circumscribe only a portion of said container.

3. The plastic container according to claim 1 wherein said top wall portion includes a plurality of elongated raised supports extending from said neck toward said side wall portion.

4. The plastic container according to claim 1 wherein at least one of said face panels has a circular indentation.

5. The plastic container according to claim 1 wherein said bottom portion has a groove extending across the bottom and has a reinforcing rib extending transversely across the groove.

6. The plastic container according to claim 1 wherein a hollow round handle is formed in said side portion and top wall portion, said handle being located so that it is an extension of one of said connector panels, the upper end of the handle terminating adjacent to said neck.

7. The plastic container according to claim 1 wherein said handle has a parting line rib which provides firmness in said handle during lifting.

8. The plastic container according to claim 1 wherein said container is a one gallon container and uses less than 58 grams of high density polyethylene resin.

9. A plastic container comprising:

a bottom portion, said bottom portion has a groove extending across the bottom and has a reinforcing rib extending transversely across the groove;

a side wall portion joined to said bottom portion comprising four face panels and four somewhat smaller in width connector panels connected at their vertical sides to one side of one of said face panels, the connection of said four face panels and said four connector panels forming an octagon, said side wall portion having a recessed area which from the top of said recess to the bottom of said recess is sufficiently wide to accommodate a label surrounding said container circumscribing said container;

a top wall portion, said top wall portion extending from said side wall portion and merging to a neck which defines an outlet for the container;

a hollow round handle is formed in said side portion and top wall portion, said handle being located so that it is an extension of one of said connector panels, the upper end of the handle terminating adjacent to said neck; and at least two of said wall panels define a series of ribs that circumscribe the container horizontally below the hollow handle and within said recessed area to rigidify said sidewall panel.

10. The plastic container according to claim 9 wherein said top wall portion includes a plurality of elongated raised supports extending from said neck toward said side wall portion.

11. The plastic container according to claim 9 wherein at least one of said face panels has a circular insert.

* * * * *